United States Patent [19]

Allen

[11] 4,091,490

[45] May 30, 1978

[54] SKIN CLEANSING DEVICE

[76] Inventor: Michael L. Allen, 13011 Meridian Ave. S. #M-202, Puyallup, Wash. 98371

[21] Appl. No.: 732,466

[22] Filed: Oct. 14, 1976

[51] Int. Cl.[2] ..... A46B 3/08; A47K 7/02

[52] U.S. Cl. ..... 15/159 A; 15/195; 15/226; 128/304

[58] Field of Search ..... 15/159 R, 159 A, 160, 15/195, 222, 225, 226, 208, DIG. 6; 128/304; 132/76.5

[56] References Cited

U.S. PATENT DOCUMENTS

| | | | |
|---|---|---|---|
| 506,869 | 10/1893 | Boardman | 15/222 |
| 550,799 | 12/1895 | Mumford | 300/21 |
| 624,464 | 5/1899 | Erickson | 15/159 R |
| 642,484 | 1/1900 | Phillips | 15/195 |
| 728,159 | 5/1903 | Burkart | 15/222 |
| 824,013 | 6/1906 | Harrison | 15/208 |
| 878,344 | 2/1908 | Chazal | 15/225 X |
| 988,194 | 3/1911 | Hymes | 15/225 X |

FOREIGN PATENT DOCUMENTS

| | | | |
|---|---|---|---|
| 209,347 | 1/1924 | United Kingdom | 15/160 |

OTHER PUBLICATIONS

Book entitled "Brushmaking Materials" , by F. Kidd, 1957-Partridge Printers Ltd., Great Britain, TS2301-B8K5, p. 22.

*Primary Examiner*—Daniel Blum
*Attorney, Agent, or Firm*—Limbach, Limbach & Sutton

[57] ABSTRACT

A skin cleansing device has skin contacting elements of human hair attached to a backing member and being of sufficient length and flexibility that, when wetted and brought into cleansing contact with the skin of a user, the skin contact is predominantly with the sides of the hair elements rather than the ends thereof.

4 Claims, 11 Drawing Figures

SKIN CLEANSING DEVICE

BACKGROUND OF THE INVENTION

Numerous objects have been employed in the cleansing of human skin, the most common being terry-cloth face cloths and complexion brushes. For proper complexion care it has been found necessary not only to remove accumulated dirt and oil from the skin but also to abrade the skin gently to remove the outermost layer of dead skin cells. This removal of the outer layer of dead cells facilitates the youthful and healthy look of the skin which is desirable. While face cloths and conventional complexion brushes have each been suitable for the application of soap and the removal of accumulated dirt and oil from the skin, none has been completely satisfactory in providing the gentle abrasion which is desirable. This failing of the prior art implements is due primarily to the texture and surfaces of the materials used being unsuited for the necessary abrasion.

SUMMARY OF THE INVENTION

It is an object of this invention to provide a novel skin cleansing device having a gently abrading skin contacting element. It is another object of this invention to provide such a skin cleansing device in which the skin contacting elements are formed of human hair. It is yet another object of the invention to provide such a skin cleansing device in which the skin contact is predominantly with the sides of the hair rather than the ends thereof.

It has been found that a skin cleansing device utilizing the sides of human hair strands, such as in a matted mass of wet hair, provides an abrading action which gently removes the outermost layer of dead skin cells when applied to the body. This action is especially desirable to eliminate any build-up of such dead skin cells, known as "slag". Thus, by this gentle abrading action, a person's skin may be left looking younger and healthier than would be the case with conventional complexion brushes or face cloths. While various fibers have been tested in this application it has been found that the physical characteristics of human hair, such as its flexible and durable nature and texture, is especially suited to the job.

BRIEF DESCRIPTION OF THE DRAWINGS

The invention having been generally described, several particularly preferred embodiments will be described in detail with respect to the following drawings in which.

DESCRIPTION OF ILLUSTRATIVE EMBODIMENTS

A first and particularly preferred embodiment of the skin cleansing device of this invention is illustrated in FIGS. 1 through 4 as a coil arrangement of strip-like elements. This embodiment is formed from a large plurality of tufts 2 of human hair, suitably all of generally equal length and folded at their centers. These tufts are then placed between the opposed sides of a folded length of flexible tape 4, suitably a woven cloth tape, which is folded around the ends of each of these tufts and sewn with stitching 6. This stitching serves both to hold the tape in place and to lock the numerous tufts 2 within the folds of the tape 4. Thus, the tape 4 forms the backing member to which the skin contacting elements of human hair are attached.

Figure 2:
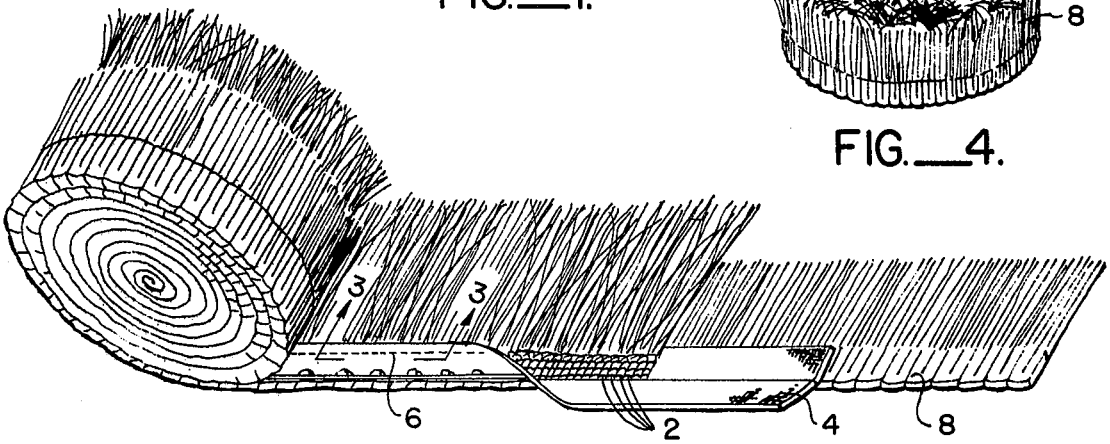
FIG. 2 illustrates the cleansing device of FIG. 1 in a partially unrolled configuration illustrating the construction thereof.
Figure 3:
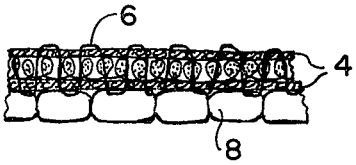
FIG. 3 is a fragmentary sectional view taken along line 3—3 of FIG. 2.

To complete the fabrication of this embodiment of the skin cleansing device, the folded and sewn backing member 4 may suitably be positioned atop and aligned with a spacing element 8 of a suitable flexible material. This spacing element 8 preferably is in the form of an extended row of woven or otherwise mutually attached tassles or tufts of a textile material, such as cotton. Suitably, the tufts may be sewn together to form the desired long strip 8. With the backing member 4 having the hair tufts attached thereto thus aligned with and overlying the spacing element 8, the combination may then be rolled into a coil, as illustrated in FIG. 2, and held in that configuration by some convenient means such as by sewing, thus forming the cleansing device of FIG. 1 in which extended portions of the sewn cloth tape and attached hair elements are coiled into adjacent side-by-side relationship with other such portions.

Figure 1:
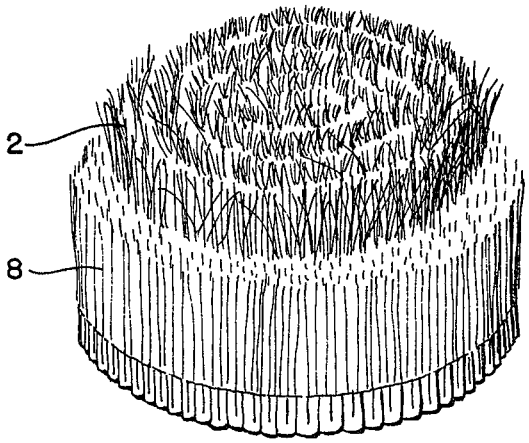
FIG. 1 represents the preferred embodiment of the cleansing element of this invention.
Figure 4:
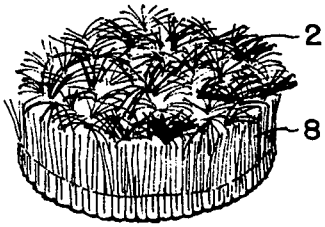
FIG. 4 illustrates the cleansing device of FIG. 1 when in its wetted condition for use.

The skin contacting elements 2 of human hair in this embodiment are made up of sufficient length and flexibility that, when the cleansing device is wetted for the desired scrubbing, the hair tufts become matted and entangled, as illustrated in FIG. 4. By virtue of this matting and entanglement, the skin contact is predominantly with the sides of the hair tufts rather than the ends thereof. This side contact thus provides the desired scrubbing and gentle abrading action for treatment of the skin upon which it is used. It has been found that hair tufts for this embodiment suitably may project about one half inch to one inch outwardly of the backing member 4. The spacing element 8 serves to provide additional bulk and space apart the skin contacting elements 2 of human hair.

Figure 5:
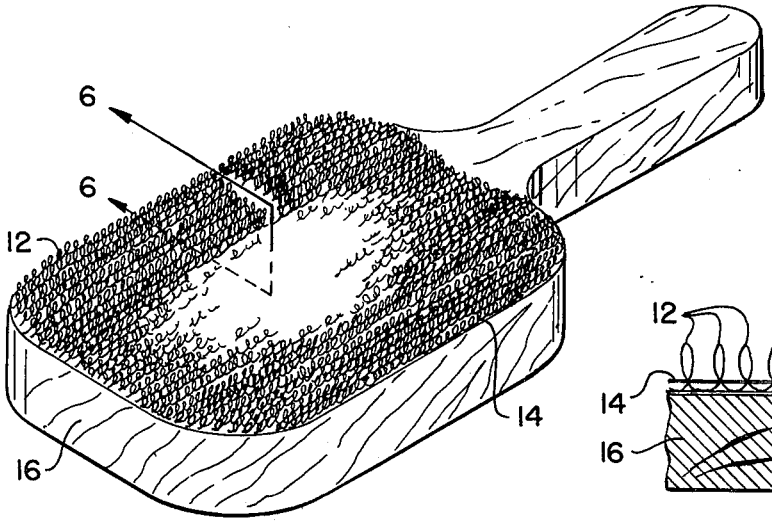
FIG. 5 illustrates an alternate embodiment of the cleansing element.
Figure 6:
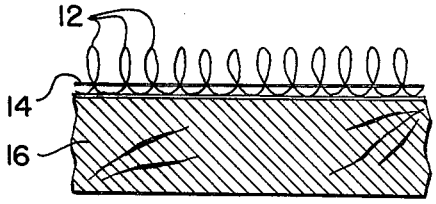
FIG. 6 is a side sectional view of a portion of the cleansing device of FIG. 5.

Another embodiment of the skin cleansing device is illustrated in FIG. 5. In this embodiment, which is also illustrated in section in FIG. 6, the skin contacting elements 12 are formed of strands of human hair attached to a backing member 14 which may suitably be a natural or synthetic woven fabric, which is in turn attached, suitably adhesively, to a substantially rigid handle or support member 16. The handle suitably is of conventional material such as wood or plastic. Skin contacting elements 12 may be either individual or groups of strands of the human hair which have portions thereof inserted through the backing material 14, in a manner analogous to that used producing tufted carpeting. Thus may be produced a multitude of adjacent rows of the arcuate, looped skin contacting elements 12.

Figure 8:
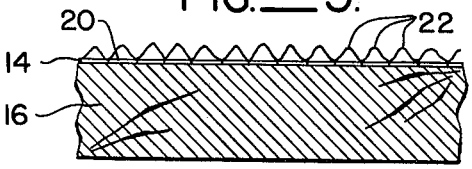
FIGS. 7 and 8 illustrate alternate embodiments of the skin contacting elements of the cleansing device of FIG. 5.
Figure 7:
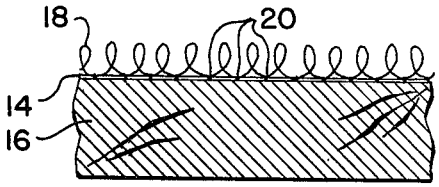

An alternate method of producing a cleansing device similar to that of FIG. 5 is illustrated in the section of FIG. 7. In this embodiment the strands 18 of human hair are formed into numerous adjacent rows of arcuate loops, similar in appearance to those of the embodiment of FIG. 6, but lying entirely atop backing member 14. Then with these looped strands 18 in place numerous rows of stitching 20 are applied to the strands and backing member to sew those strands in place and thus maintain them in their arcuate, looped configuration. With the strands 18 thus affixed to backing member 14, the combination may then be attached, as by adhesives, to the handle member 16. A similar manner of construction is used to produce the embodiment of FIG. 8, which is substantially identical to that of FIG. 7 but with the strands 22 of hair formed only into arched projections rather than the complete arcuate loops of FIGS. 6 and 7.

Figure 9:
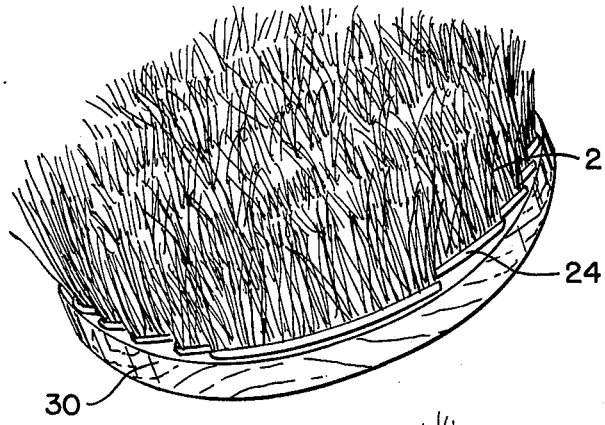
FIG. 9 represents a third embodiment of the skin cleansing device.
Figure 10:
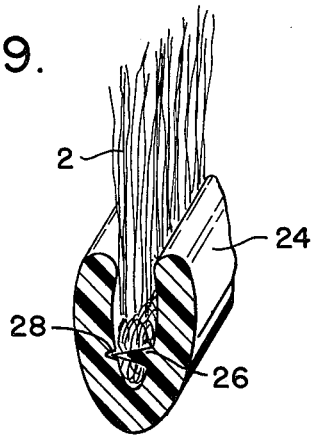
FIG. 10 is a fragmentary sectional view of the skin contacting element and backing member of the embodiment of FIG. 9.
Figure 11:
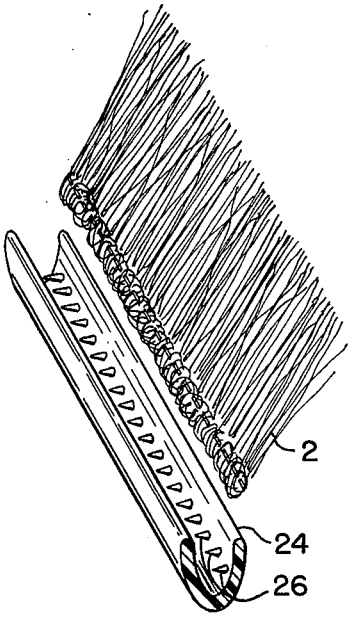
FIG. 11 is an exploded view of the skin contacting elements and backing element of the embodiment of FIG. 9.

A third preferred embodiment of the skin cleansing device is illustrated in FIGS. 9 through 11. In this embodiment folded lengths of hair 2 similar to those illustrated in FIG. 2 above are inserted into a heat-deformable plastic channel backing member 24 best illustrated in FIGS. 10 and 11. Along one inwardly facing side of the channel 24 are formed a large plurality of closely spaced projecting teeth 26. Suitably, along the facing side of the channel 24 are provided a plurality of mating indentations 28 for receiving the ends of teeth 26. Thus, the folded tufts of hair 2 may be laid in the channel of the backing member 24 atop the teeth 26. Then, while the channel 24 is momentarily softened by the application of heat from a convenient source such as a heated press, the opposed sides of the channel 24 may be brought together, bringing the teeth 26 into mating engagement with the opposed depressions 28. Upon cooling of the channel 24 the teeth will be retained in their mating engagement with the depressions 28, thus locking the tufts of hair 2 in place and forming an elongated strip of the backing member and hair tufts. Then, if desired, the elongated strip may be curved into a sinuous pattern and attached to a substantially rigid backing member 30, as illustrated in FIG. 9. The skin cleansing device thus formed will also have the matting and entangling characteristics described in regard to the first embodiment above.

While three particularly desirable embodiments of the skin cleansing device have been described above in substantial detail, these descriptions are to be considered only as illustrative of the principles of the invention and not limitative thereof. Accordingly, since numerous variations and modifications of the skin cleansing device, all within the scope of the invention, will readily occur to those skilled in the art, the scope of the invention is to be limited solely by the claims appended hereto.

What is claimed is:

1. A skin cleansing device comprising a backing member in the form of a strip of flexible material, skin contacting elements of human hair attached along and extending outwardly of said backing member and being of sufficient length and flexibility that, when wetted and brought into cleansing contact with the skin of the user, said skin contact is predominantly with the sides of said hair elements rather than the ends thereof, means forming and maintaining said elongated backing member and attached hair elements in a configuration with portions of said backing member strip and hair elements in generally adjacent side-by-side relationship with other said portions, and a spacing element comprising tassles of textile material interposed between adjacent said side-by-side portions of said hair elements attached to said backing strip, said tassles extending generally in the same direction as said hair elements.

2. A skin cleansing device according to claim 1 wherein said backing member strip is coiled, and wherein said skin cleansing device further comprises means for maintaining said coiled backing member strip in said coiled configuration.

3. A skin cleansing device according to claim 1 wherein said skin contacting elements comprise folded tufts of said human hair with the folds thereof attached to said backing member.

4. A skin cleansing device according to claim 3 wherein said tufts are sewn between two strips of a flexible backing tape.

* * * * *